US012742403B2

(12) United States Patent
Opipari et al.

(10) Patent No.: US 12,742,403 B2
(45) Date of Patent: Sep. 22, 2026

(54) VARIABLE DISPLACEMENT VALVETRAIN SYSTEMS WITH ROCKER SHAFT PORTING AND INSERT SLEEVES FOR ENGINE CYLINDER DEACTIVATION

(71) Applicant: GM GLOBAL TECHNOLOGY OPERATIONS LLC, Detroit, MI (US)

(72) Inventors: Anteo C. Opipari, Saugatuck, MI (US); Paul Austin, Rockford, MI (US); Rolando Huerta Ortiz, Wyoming, MI (US); Brian J. Warner, Hudsonville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 271 days.

(21) Appl. No.: 18/745,038

(22) Filed: Jun. 17, 2024

(65) Prior Publication Data

US 2025/0382903 A1 Dec. 18, 2025

(51) Int. Cl.
*F01L 1/18* (2006.01)
*F01L 1/14* (2006.01)
(Continued)

(52) U.S. Cl.
CPC ..... *F01L 1/181* (2013.01); *F01L 1/146* (2013.01); *F01L 1/2416* (2013.01);
(Continued)

(58) Field of Classification Search
CPC ... F01L 1/18; F01L 1/181; F01L 1/146; F01L 1/24; F01L 1/2416; F01L 1/2422;
(Continued)

(56) References Cited

U.S. PATENT DOCUMENTS 6,394,067 B1 * 5/2002 Usko ..... F01L 13/06 123/321
6,491,008 B1 12/2002 Zubeck
(Continued)

FOREIGN PATENT DOCUMENTS

DE 10360293 A1 10/2004
DE 102010005296 A1 12/2010
(Continued)

*Primary Examiner* — Loren C Edwards
(74) *Attorney, Agent, or Firm* — Quinn IP Law

(57) ABSTRACT

A valvetrain control system includes a rocker shaft that attaches to an engine assembly and includes an internal bore that receives hydraulic fluid. An oil control valve (OCV) is attached to the rocker shaft and fluidly coupled to the internal bore to receive therefrom hydraulic fluid. Pivotably mounted onto the rocker shaft is a rocker arm with opposing ends thereof that mate with a pushrod and a valve. The rocker arm includes a spring lock unit that attaches to the pushrod and fluidly couples to the OCV to receive hydraulic fluid and thereby drivingly disengage the rocker arm from the pushrod. An insert sleeve mounted in the internal bore receives hydraulic fluid from the rocker shaft. The insert sleeve includes a feed port that transmits hydraulic fluid from the insert sleeve to the OCV, and a feed pocket that transmits hydraulic fluid from the OCV to the spring lock unit.

20 Claims, 4 Drawing Sheets

(51) Int. Cl.
*F01L 1/24* (2006.01)
*F01L 13/00* (2006.01)

(52) U.S. Cl.
CPC ... *F01L 13/0005* (2013.01); *F01L 2001/2444* (2013.01); *F01L 2013/001* (2013.01)

(58) Field of Classification Search
CPC ..... F01L 2001/2433; F01L 2001/2444; F01L 13/0005; F01L 2013/001; F01L 9/10
See application file for complete search history.

(56) References Cited

U.S. PATENT DOCUMENTS

| | | | | |
|---|---|---|---|---|
| 7,040,265 | B2 | 5/2006 | Falkowski et al. | |
| 7,249,584 | B2 | 7/2007 | Rozario | |
| 7,278,391 | B1 | 10/2007 | Wong | |
| 7,367,313 | B2 | 5/2008 | Chang et al. | |
| 7,610,887 | B2 | 11/2009 | Spath | |
| 7,651,441 | B2 | 1/2010 | Maguire | |
| 7,677,213 | B2 | 3/2010 | Deierlein | |
| 7,689,343 | B2 | 3/2010 | Dagci et al. | |
| 7,698,048 | B2 | 4/2010 | Jung | |
| 8,196,556 | B2 | 6/2012 | Hendriksma | |
| 8,662,035 | B1 | 3/2014 | Hendriksma | |
| 8,770,162 | B2 | 7/2014 | Hendriksma | |
| 10,968,787 | B2 | 4/2021 | Church | |
| 12,180,866 | B1 | 12/2024 | Opipari et al. | |
| 2015/0159521 | A1* | 6/2015 | Baltrucki | F01L 1/24 123/90.12 |
| 2020/0088073 | A1* | 3/2020 | Baltrucki | F01L 9/10 |
| 2020/0224561 | A1* | 7/2020 | Baltrucki | F02D 13/0269 |
| 2021/0131315 | A1* | 5/2021 | Sarati | F01L 1/047 |
| 2022/0298934 | A1* | 9/2022 | Rezkalla | B23C 3/00 |
| 2022/0298935 | A1* | 9/2022 | Baltrucki | F01L 1/267 |

FOREIGN PATENT DOCUMENTS

| | | | |
|---|---|---|---|
| DE | 212016000178 | U1 | 6/2018 |
| WO | 2021121667 | A1 | 6/2021 |
| WO | 2024132215 | A1 | 6/2024 |

* cited by examiner

VARIABLE DISPLACEMENT VALVETRAIN SYSTEMS WITH ROCKER SHAFT PORTING AND INSERT SLEEVES FOR ENGINE CYLINDER DEACTIVATION

INTRODUCTION

The present disclosure relates generally to combustion-type engines. More specifically, aspects of this disclosure relate to variable displacement valvetrain systems for cylinder deactivation of reciprocating-piston type internal combustion engine assemblies.

Current production motor vehicles, such as the modern-day automobile, are originally equipped with a powertrain that operates to propel the vehicle and power the vehicle's onboard electronics. In automotive applications, for example, the vehicle powertrain is generally typified by a prime mover that delivers driving torque through an automatic or manually shifted power transmission to the vehicle's final drive system (e.g., differential, axle shafts, corner modules, road wheels, etc.). Automobiles have historically been powered by a reciprocating-piston type internal combustion engine (ICE) assembly due to its ready availability and relatively inexpensive cost, light weight, and overall efficiency. Such engines include compression-ignited (CI) diesel engines, spark-ignited (SI) gasoline engines, two, four, and six-stroke architectures, and rotary engines, as some non-limiting examples. Hybrid-electric vehicles (HEV) and full-electric vehicles (FEV), on the other hand, utilize alternative power sources to propel the vehicle and, thus, minimize or eliminate reliance on a fossil-fuel based engine for tractive power.

A typical overhead valve (OHV) engine assembly is constructed with an engine block that contains a succession of internal cylinder bores, each of which has a piston reciprocally movable therein. Mounted onto the engine block is a cylinder head that cooperates with each cylinder bore-and-piston pair to form a variable-volume combustion chamber. These reciprocating pistons are used to convert pressure—generated by igniting a fuel-and-air mixture inside the combustion chamber—into rotational forces to drive an engine crankshaft. The cylinder head defines intake ports through which air, provided by an intake manifold, is introduced into each combustion chamber. Exhaust ports defined in the cylinder head evacuate exhaust gases and byproducts of combustion from the discrete combustion chambers to an exhaust manifold. This exhaust manifold, in turn, collects and combines exhaust gases for metered recirculation into the intake manifold, delivery to a turbine-driven turbocharger, or evacuation from the vehicle through an exhaust system.

Four-stroke combustion engines commonly operate—as the name suggests—in four distinct stages or "strokes" to drive the engine's crankshaft. At an initial (first) stage of operation, referred to as the "intake stroke," a metered mixture of fuel (or just air for compression-ignited diesel engines) is fed into each engine cylinder as the piston travels rectilinearly from top-to-bottom along the length of the bore. Engine intake valves are opened such that a vacuum pressure generated by the downward-travelling piston draws air into the chamber. For direct-injection systems, a metered quantity of finely atomized fuel is introduced into the chamber via a fuel injector. During a subsequent (second) stage, referred to as the "compression stroke," the intake and exhaust valves are closed as the piston travels from bottom-to-top and concomitantly compresses the fuel-air mixture. Upon completion of the compression stroke, a following (third) stage or "power stroke" commences when a spark plug (or pure compression for diesel engines) ignites the compressed fuel and air, with the resultant expansion of gases pushing the piston back to bottom dead center (BDC). During a successive stage—known as the "exhaust stroke"—the piston once again returns to top dead center (TDC) with the exhaust valves open; the travelling piston expels the spent air-fuel mixture from the combustion chamber.

During operation of multi-cylinder engine assemblies, one or more of the cylinders may be withdrawn from firing service in order to enhance fuel efficiency under low-demand conditions. Select cylinder deactivation—commonly referred to as "variable displacement"—may be accomplished in a variety of ways, including the use of a variable valve lift (VVL) unit with an electronically or hydraulically controlled locking device that may be unlocked to thereby operatively disengage the pushrod from the rocker arm. Real-time VVL switching may be governed using an electronic solenoid valve to selectively pass oil from a hydraulic oil manifold to the VVL unit's switchable locking elements on command from an Engine Control Module (ECM). ECM activation of the solenoid valve will increase the hydraulic pressure within the VVL unit; when the internal hydraulic pressure reaches a spring force threshold of the locking device, the VVL unit drivingly disengages the pushrod from the rocker arm such that the rocker arm no longer activates the intake valve. Variable displacement valvetrain systems employ an oil pressure control system to maintain operational oil pressures at both a relatively low level, to enable firing of all cylinders, and a relatively high level, to deactivate firing of select cylinders.

SUMMARY

Presented below are variable displacement valvetrain (VDV) systems with rocker shaft fluid porting and insert sleeves for engine cylinder deactivation, methods for making and methods for using such VDV systems, and motor vehicles with such VDV systems. In a non-limiting example, valvetrain control systems and methods are presented for engine cylinder deactivation using pressurized switching-oil routing within the rocker shaft in combination with pushrod disengagement at the rocker-rod interface (as opposed to the pushrod-valve lifter interface). The valvetrain control system's oil flow gallery routes oil from a feed passage in the cylinder head, into and through the rocker shaft and an insert sleeve within the rocker shaft, to an oil control valve (OCV) that is mounted onto a manifold that circumscribes the rocker shaft. The OCV is selectively activated to transmit oil to a worm track that is recessed into the exterior of the insert sleeve; the worm track feeds oil through a delivery port in the rocker shaft to a spring lock deactivation (DEAC) unit that is integrated into a pushrod-mating end of the rocker arm. Pressurizing the spring lock deactivation unit operatively disengages the rocker arm from the pushrod and thereby prevents the transmission of motion/load from the pushrod to the rocker arm; doing so deactivates the rocker arm and an intake/exhaust valve mated with that rocker.

To regulate the flow of oil through the rocker shaft, an outer-diameter (OD) surface of the insert sleeve may sit flush against and seal to an inner-diameter (ID) surface of the rocker shaft. Switching oil may pass from the pressurized oil bore in the rocker shaft through open longitudinal ends of the insert sleeve; an oil feed port in the circumferential wall of the insert sleeve directs oil into an inlet port of the OCV. When activated, the OCV transmits oil flow from the OCV inlet port to an OCV control port; this control port redirects oil flow, e.g., via a control port passage in the OCV manifold, through a sleeve track pocket to a worm track in the sleeve. The worm track delivers oil flow through an inlet channel in the rocker arm to the spring lock unit. The OCV includes a pressure-regulating port and a floating check valve that allows a minimum "priming" pressure to be maintained in the control gallery. This priming pressure is sufficient to enable fast switching of the VDV system, but low enough to ensure the VDV system does not inadvertently deactivate the rocker arms when it is not required.

Attendant benefits for at least some of the disclosed concepts may include a simplified and reduced cost VVL system that routes switching oil through the rocker shafts to the rocker arm spring lock units. Using this routing arrangement allows for minimal changes to existing engine architecture while eliminating superfluous hoses, seals, valving, etc. Other attendant benefits may include a VVL system that minimizes the amount of oil pulled from the existing engine oiling system while still providing the necessary oil and pressure to actuate the cylinder deactivation system and maintaining oil feed to the pushrod-to-rocker arm interface and rocker arm-rocker shaft interface.

Aspects of this disclosure are directed to optimized VDV systems with fluid-ported rocker shafts and rocker shaft insert sleeves for engine cylinder deactivation (or 2-step valve lift). In an example, there is presented a valvetrain control system for an engine assembly, which has multiple cylinders, intake and exhaust valves for opening and closing intake and exhaust port to each cylinder, a camshaft rotatably attached proximate the valves, and multiple pushrods (e.g., with pushrod lifters) each seated on a respective cam of the camshaft. The valvetrain control system includes a rocker shaft that attaches to the engine assembly and includes an internal shaft bore for receiving hydraulic fluid. An oil control valve unit attaches to the rocker shaft and fluidly couples to the internal shaft bore to receive therefrom a portion of the hydraulic fluid. Multiple rocker arms pivotably mount onto the rocker shaft; one end of each rocker arm mates with a respective pushrod while the opposite end of the rocker arm mates with a respective valve. A subset of the rocker arms each includes a hydraulically actuated spring lock unit that is mounted to, integrally formed with, or otherwise attached to the pushrod end of the rocker arm. Each spring lock unit attaches its rocker arm to the pushrod and fluidly couples to the OCV unit. Receipt of hydraulic fluid from the OCV unit causes the spring lock unit to drivingly disengage the rocker arm from the pushrod. An insert sleeve is mounted inside the rocker shaft's internal bore to receive hydraulic fluid from the rocker shaft. The insert sleeve includes a feed port that transmits hydraulic fluid from the rocker shaft and insert sleeve to an OCV inlet port of the OCV unit, and a feed pocket that transmits hydraulic fluid from an OCV outlet port of the OCV unit to each spring lock unit.

Additional aspects of this disclosure are directed to motor vehicles equipped with variable displacement valvetrain systems with fluid-ported rocker shafts and rocker shaft insert sleeves for cylinder/valve deactivation. As used herein, the terms "vehicle" and "motor vehicle" may be used interchangeably and synonymously to include any relevant vehicle platform, such as passenger vehicles (e.g., ICE, HEV, FCHEV, fully and partially autonomous, etc.), commercial vehicles, industrial vehicles, tracked vehicles, off-road and all-terrain vehicles (ATV), motorcycles, farm equipment, aircraft, watercraft, spacecraft, etc. In an example, a motor vehicle includes a vehicle body with a passenger compartment, multiple road wheels mounted to the vehicle body (e.g., via corner modules coupled to a unibody or body-on-frame chassis), and other standard original equipment. An internal combustion engine assembly is attached to the vehicle body (e.g., supported on engine mounts inside an engine bay) and operable to drive one or more of the road wheels to thereby propel the motor vehicle.

Continuing with the discussion of the foregoing vehicle example, the ICE assembly includes an engine block with multiple cylinder bores, a cylinder head mounted onto the engine block and covering the cylinder bores, and multiple pistons each reciprocally movable within a respective one of the cylinder bores. Multiple intake valves are movably attached to the cylinder head and each operable to open and close an intake port to a respective one of the cylinder bores. The ICE assembly also includes a camshaft that is rotatably attached to the engine block and carries a series of cams; a series of pushrods with pushrod lifters is each slidably seated on a respective one of the camshaft cams. A rocker shaft, which is rigidly mounted onto the cylinder head, has an internal shaft bore that receives hydraulic fluid from a feed passage in the cylinder head. An OCV unit is mounted onto the rocker shaft and fluidly coupled to the internal shaft bore to receive a portion of the hydraulic fluid.

Multiple rocker arms are pivotably mounted onto the rocker shaft; each rocker arm mates at one end thereof with a respective pushrod and at an opposite end thereof with a valve stem of a respective intake valve (or exhaust valve). A subset of the rocker arms each has a respective spring lock unit attached to the pushrod end of the rocker arm. Each spring lock unit attaches the rocker arm to its respective pushrod and fluidly couples to the OCV unit. Receipt of high-pressure hydraulic fluid from the OCV unit causes the spring lock unit to drivingly disengage the rocker arm from the pushrod. An insert sleeve is mounted inside of the rocker shaft's internal bore to receive therefrom the hydraulic fluid. The insert sleeve has a feed port that transmits hydraulic fluid from the insert sleeve to an OCV inlet port of the OCV unit, and a feed pocket that transmits hydraulic fluid from an OCV outlet port of the OCV unit to the spring lock units of the subset of the rocker arms.

Aspects of this disclosure are also directed to methods for manufacturing and methods for operating any of the herein-described valvetrain systems, engine assemblies, and/or motor vehicles. In an example, a method is presented for assembling a valvetrain control system for an engine assembly. The engine assembly has multiple cylinders, multiple valves for opening and closing ports to the cylinders, a camshaft rotatably attached proximate the valves, and multiple pushrods with lifters seated on cams of the camshaft. This representative method includes, in any order and in any combination with any of the above and below disclosed options and features: attaching a rocker shaft to the engine assembly, the rocker shaft including an internal shaft bore configured to receive hydraulic fluid; attaching an OCV unit to the rocker shaft; fluidly coupling the OCV unit to the internal shaft bore of the rocker shaft to receive therefrom the hydraulic fluid; pivotably mounting a rocker arm onto the rocker shaft; mating a first end of the rocker arm with the pushrod; mating a second end of the rocker arm with the valve; attaching a spring lock unit, which is attached to the first end of the rocker arm, to the pushrod; fluidly coupling the spring lock unit to the OCV unit to receive therefrom hydraulic fluid to thereby drivingly disengage the rocker arm from the pushrod; and mounting an insert sleeve inside the internal shaft bore to receive the hydraulic fluid from the rocker shaft, the insert sleeve including a feed port for transmitting hydraulic fluid from the internal shaft bore and the insert sleeve to an OCV inlet port of the OCV unit, and a feed pocket for transmitting hydraulic fluid from an OCV outlet port of the OCV unit to the spring lock unit.

For any of the disclosed VDV systems, vehicles, and methods, the insert sleeve may have an elongated and hollow sleeve body, such as a right-circular cylinder fabricated from carbon steel. In this instance, the feed port is a through-hole that extends through a sidewall of the sleeve body, whereas the feed pocket is an elongated channel recessed into the outer surface of the sleeve body. The insert sleeve may also include an elongated and rectilinear worm track that is recessed into the outer surface of the sleeve body, fluidly coupled to the feed pocket, and extends longitudinally along the length of the insert sleeve. As another option, the rocker arm may include an inlet channel that fluidly couples to a feed orifice, which extends through a circumferential wall of the rocker shaft. In this instance, the worm track fluidly couples the inlet channel and feed orifice to the feed pocket and OCV outlet port to transmit hydraulic fluid from the OCV to the spring lock unit. It may be desirable that the insert sleeve be press-fit, slip-fit or transition-fit into the rocker shaft such that the sleeve's outer surface sits flush against and thereby seals to the rocker shaft's inner surface. Moreover, the insert sleeve may be cast and precision machined as a single-piece cylindrical structure formed, in whole or in part, from a metallic material or a rigid polymeric material.

For any of the disclosed VDV systems, vehicles, and methods, the OCV unit may include a protective valve housing with an inlet chamber, a control duct, and a check valve. The inlet chamber is fluidly coupled to the OCV inlet port, the control duct is fluidly coupled to the OCV outlet port, and the check valve is interposed between the inlet chamber and control duct. The OCV unit is selectively switchable (e.g., via command signal from the ECM) to transition between an OFF state and an ON state. When in the OFF state, the check valve restricts hydraulic fluid flow from the OCV inlet port to the OCV outlet port. When in the ON state, the check valve permits unrestricted hydraulic fluid flow from the OCV inlet port to the OCV outlet port. The check valve may include a solenoid-controlled check ball that seats against a valve seat. When the OCV unit is in the OFF state, the check ball may be at least partially unseated from the valve seat to maintain a predefined priming pressure in the hydraulic fluid. The OCV unit may also include a pressure relief valve that regulates the priming pressure when the OCV unit is OFF (e.g., ensure the priming pressure does not reach a valve deactivation pressure).

For any of the disclosed VDV systems, vehicles, and methods, the spring lock unit may include an outer lock housing, a pushrod piston that is translatable within the lock housing, and a spring-biased lock pin that locks the pushrod piston to the lock housing. The pushrod piston may include a pushrod seat that seats therein one end of the pushrod. A lost-motion return spring may be disposed within the lock housing to bias the pushrod piston towards the pushrod. Hydraulic fluid fed from the OCV unit through the insert sleeve and into the lock housing, e.g., upon reaching the valve deactivation pressure, disengages the spring-biased lock pin to thereby unlock the pushrod piston from the lock housing, thereby drivingly disengaging the pushrod from the rocker arm. Disengaging the spring-biased lock pin enables the pushrod piston and the pushrod to translate against a return spring in the lock housing. The lock housing may be integrally formed with the pushrod end of the rocker arm as a single-piece structure.

For any of the disclosed VDV systems, vehicles, and methods, each OCV unit may physically mount directly onto and circumscribe the OD surface of the rocker shaft (e.g., eliminating superfluous plumbing between the OCV and rocker shaft). In the same vein, each rocker arm and spring lock unit may physically mount directly onto and circumscribe the OD surface of the rocker shaft (e.g., eliminating superfluous plumbing between the OCV and rocker arm). One end of the rocker shaft may include an inlet port that extends through a sidewall of the rocker shaft and fluidly couples to and receives hydraulic fluid from a feed passage in the engine's cylinder head. The rocker shaft may also include a shaft outlet port that extends through a sidewall of the rocker shaft and fluidly couples to the shaft inlet port via the internal shaft bore. The rocker shaft's outlet port aligns with and directly fluidly couples to the OCV unit's inlet port and the insert sleeve's feed port.

The above summary does not represent every embodiment or every aspect of the present disclosure. Rather, the foregoing summary merely provides a synopsis of some of the novel concepts and features set forth herein. The above features and advantages, and other features and attendant advantages of this disclosure, will be readily apparent from the following Detailed Description of illustrated examples and representative modes for carrying out the disclosure when taken in connection with the accompanying drawings and appended claims. Moreover, this disclosure expressly includes any and all combinations and subcombinations of the elements and features presented above and below.

Figure 1:
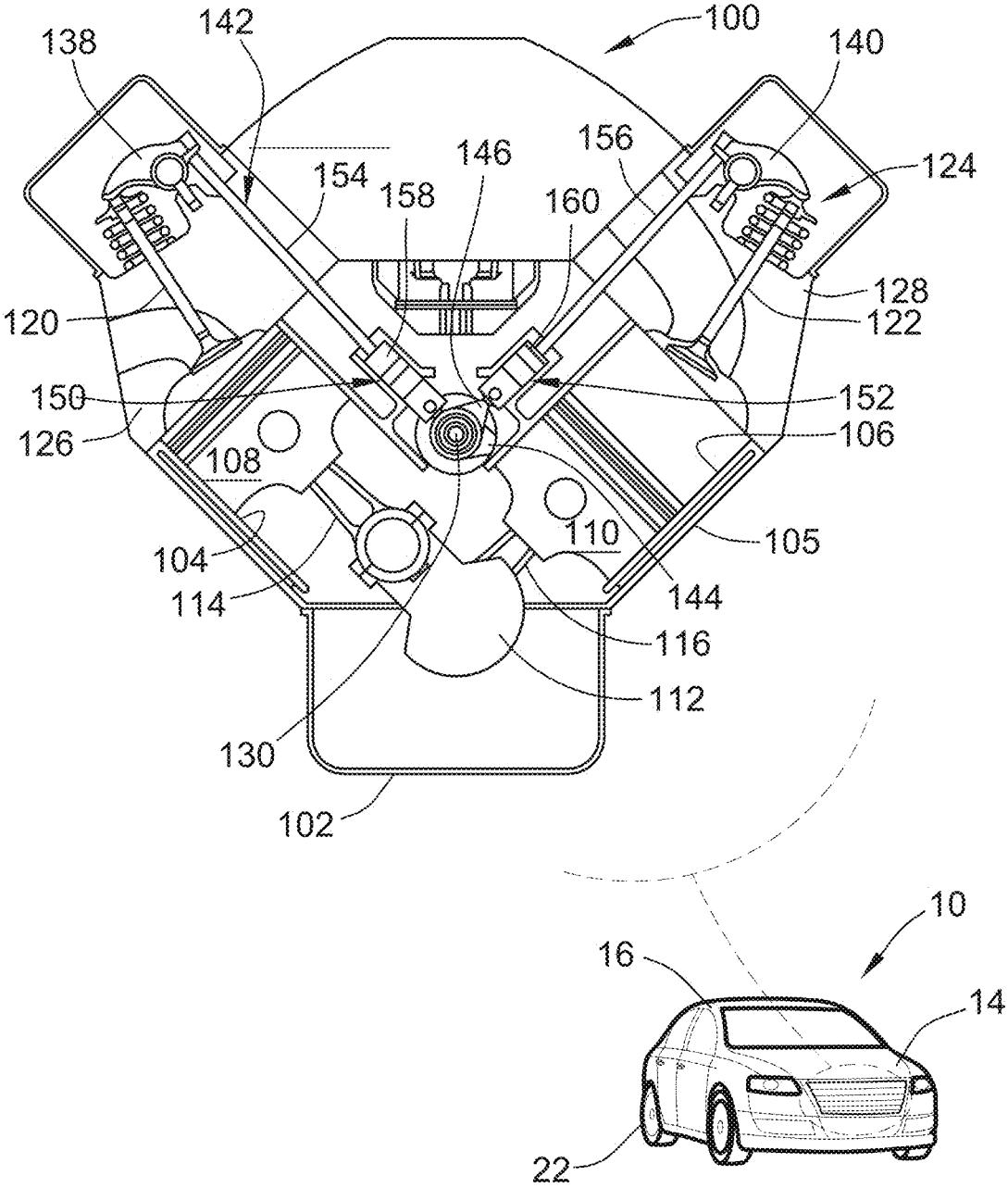
FIG. 1 is a front, perspective-view illustration of a representative motor vehicle with an inset schematic illustration of a representative reciprocating-piston type internal combustion engine assembly which may utilize a variable displacement valvetrain system for engine cylinder deactivation in accordance with aspects of the present disclosure.

The present disclosure is amenable to various modifications and alternative forms, and some representative embodiments of the disclosure are shown by way of example in the drawings and will be described in detail herein. It should be understood, however, that the novel aspects of this disclosure are not limited to the particular forms illustrated in the above-enumerated drawings. Rather, this disclosure covers all modifications, equivalents, combinations, permutations, groupings, and alternatives falling within the scope of this disclosure as encompassed, for example, by the appended claims.

DETAILED DESCRIPTION

This disclosure is susceptible of embodiment in many different forms. Representative embodiments of the disclosure are shown in the drawings and will herein be described in detail with the understanding that these embodiments are provided as an exemplification of the disclosed principles, not limitations of the broad aspects of the disclosure. To that extent, elements and limitations that are described, for example, in the Abstract, Introduction, Summary, Description of the Drawings, and Detailed Description sections, but not explicitly set forth in the claims, should not be incorporated into the claims, singly or collectively, by implication, inference or otherwise. Moreover, recitation of "first", "second", "third", etc., in the specification or claims is not per se used to establish a serial or numerical limitation; unless specifically stated otherwise, these designations may be used for ease of reference to similar features in the specification and drawings and to demarcate between similar elements in the claims.

For purposes of this disclosure, unless explicitly disclaimed: the singular includes the plural and vice versa (e.g., indefinite articles "a" and "an" are to be construed as meaning "one or more"); the words "and" and "or" shall be both conjunctive and disjunctive; the words "any" and "all" shall both mean "any and all"; and the words "including," "containing," "comprising," "having," and the like, shall each mean "including without limitation." Moreover, words of approximation, such as "about," "almost," "substantially," "generally," "approximately," and the like, may each be used herein to denote "at, near, or nearly at," or "within 0-5% of," or "within acceptable manufacturing tolerances," or any logical combination thereof, for example. Lastly, directional adjectives and adverbs, such as fore, aft, inboard, outboard, starboard, port, vertical, horizontal, upward, downward, front, back, left, right, etc., may be with respect to a motor vehicle, such as a forward driving direction of a motor vehicle when the vehicle is operatively oriented on a horizontal driving surface.

Referring now to the drawings, wherein like reference numbers refer to like features throughout the several views, there is shown in FIG. 1 a perspective-view illustration of a representative automobile, which is designated generally at 10 and portrayed herein for purposes of discussion as a gas-powered, sedan-style passenger vehicle. The illustrated automobile 10—also referred to herein as "motor vehicle" or "vehicle" for short—is merely an exemplary application with which novel aspects of this disclosure may be practiced. In the same vein, implementation of the present concepts into a four-stroke, spark-ignited gasoline engine of an ICE-based powertrain should also be appreciated as exemplary applications of the novel concepts disclosed herein. As such, it will be understood that features of this disclosure may be applied to other engine configurations, incorporated into alternative powertrain architectures, and utilized for any logically relevant type of motor vehicle. Lastly, only select components of the motor vehicle and engine assembly have been shown and will be described in additional detail herein. Nevertheless, the vehicles, engines and valvetrains discussed below may include numerous additional and alternative features, and other available peripheral components for carrying out the various methods and functions of this disclosure.

FIG. 1 illustrates an example of a V-type, overhead valve (OHV) internal combustion engine assembly 100 that is mounted inside an engine bay 14 of a vehicle body 16 of the motor vehicle 10. The illustrated ICE assembly 100 is a four-stroke, reciprocating-piston engine configuration that operates to drive one or more of the vehicle's road wheels 22 to thereby propel the vehicle 10, for example, as a direct injection (DI) or port fuel injection (PFI) gasoline engine, including flexible-fuel vehicle (FFV) and hybrid electric vehicle (HEV) variations thereof. The engine assembly 100 can optionally operate in any of an assortment of selectable combustion modes, including a homogeneous-charge compression-ignition (HCCI) combustion mode and a variable-lift (active fuel management (AFM)) spark-ignition (SI) combustion mode. Although not explicitly portrayed in FIG. 1, it is envisioned that the vehicle driveline may take on any available configuration, including front wheel drive (FWD) layouts, rear wheel drive (RWD) layouts, all-wheel drive (AWD) layouts, four-wheel drive (4WD) layouts, etc.

The illustrated engine assembly 100 includes a cast-metal engine block 105 with a staggered sequence of cylinder bores, such as a first cylinder bore (or set of cylinder bores) 104 and a second cylinder bore (or set of cylinder bores) 106. A ring-bearing piston 108 and 110 is reciprocally movable within each cylinder bore (or "cylinder" for short) 104, 106, i.e., to translate rectilinearly from a top-dead-center (TDC) position to a bottom-dead-center (BDC) position. A torque-transmitting engine crankshaft 112 is rotatably mounted inside an engine crankcase 102, which is fastened to the underside of the engine block 105. Each piston 108, 110 is coupled to the crankshaft 112 via a bearing-mounted connecting rod 114 and 116. Engine pistons 108, 110 are typically provided in even numbers of 4, 6, 8, etc., and arranged in a V-type or I-type configuration; however, disclosed concepts are similarly applicable to alternative cylinder counts (e.g., 3, 5, etc.) and layouts (e.g., H-type, flat, etc.). The top surface of each piston 108, 110 cooperates with the inner periphery of its corresponding cylinder 104, 106 and a respective chamber surface of a cylinder head 126 and 128 to define a variable-volume combustion chamber. The crankshaft 112, in turn, transforms the linear reciprocating motion of the pistons 108, 110 to rotational motion that is output, for example, as a number of rotations per minute (RPM) to a power transmission (not shown) to drive one or more road wheels 22.

With continuing reference to the inset view of FIG. 1, an engine valvetrain system 124 employs a set of one or more intake valves 120 and one or more exhaust valves 122 for each cylinder 104, 106 to regulate the intake and exhaust of its variable-volume combustion chamber. A pair of cylinder heads 126, 128 are mounted onto the engine block 105 to define a V-type engine configuration having two banks of cylinders 104, 106 disposed at an angle relative to each other. An air intake system (not shown) transmits intake air to the cylinders 104, 106 through an intake manifold, which directs and distributes air into the individual combustion chambers via respective intake runners and intake ports of the cylinder head 126, 128. The engine's air intake system has airflow ductwork and various electronic devices for monitoring and regulating incoming air flow. Airflow from the intake manifold into each combustion chamber is controlled by one or more of the engine intake valves 120, whereas evacuation of exhaust gases and combustion byproducts out of each combustion chamber to an exhaust manifold of an engine exhaust system is controlled by one or more of the engine exhaust valves 122.

The valvetrain system 124 employs a time-phased camshaft 130 that is rotatably mounted inside a camshaft pocket in a cylinder bank valley of the engine block 105 to selectively activate the intake and exhaust valves 120, 122. The camshaft 130 supports thereon and concomitantly rotates a series of cam lobes, such as intake and exhaust cams 144 and 146, respectively. A cam-to-rocker (CTR) drive system 142 may drivingly engage the intake and exhaust cams 144, 146 with respective rocker arms 138 and 140 to pivot the rocker arms 138, 140 and thereby open the intake and exhaust valves 120, 122. The CTR drive system 142 may include cam-engaging valve lifters 150 and 152 that are each secured to a distal (bottom) end of a respective engine pushrod 154 and 156 and slidably seated on a respective one of the cams 144, 146. The valve lifters 150, 152 transmit input forces from the camshaft cams 144, 146 to the pushrods 154, 156 to convert the rotational motion of the camshaft 130 into linear motion of the pushrods 154, 156. The valve lifters 150, 152 may each include a roller tappet 158 and 160 (as shown) or a round-tip lifter, which may take on solid or hydraulic form factors.

During engine operation, rotation of the camshaft 130 causes the intake and exhaust cams 144, 146 to push against and effect reciprocal linear translation of the lifters 158, 160 and pushrods 154, 156. The pushrods 154, 156, in turn, push against mating ends of the rocker arms 138, 140; doing so causes the rocker arms 138, 140 to pivot against and press onto valve stems of the intake and exhaust valves 120, 122. It is also envisioned that the CTR drive system 142 may employ other types of valve lift configurations, including both continuous and discrete variable valve lift (VVL) devices. For instance, activation of the engine valves 120, 122 may be modulated by controlling exhaust and intake variable cam phasing/variable lift control (VCP/VLC). It is also possible to replace the valve lifters 150, 152 with hydraulic lash adjusters or solid valve lifters. These engine valves 120, 122 are illustrated herein as spring-biased poppet valves; however, other commercially available types of engine valves may be employed.

Discussed below are variable displacement valvetrain (VDV) systems and methods with rocker shaft oil porting and rocker shaft insert sleeves that provide cylinder deactivation for combustion engines, such as OHV ICE assembly 100. By way of non-limiting example, rocker arm switching oil is routed from the cylinder head into the rocker shaft, through an insert sleeve inside the rocker shaft to a solenoid-driven valve, that then routes oil from the valve back across the insert sleeve to a subset of the rocker arms. The rocker shaft insert sleeve simplifies the flow-control system and process for directing oil through feed ports in the rocker shaft to inlet channels of the rocker arms. This helps to eliminate the need for adding more complex oil passages (e.g., precision drilling), piping, scaling, manifolds, and other auxiliary hydraulic components. Doing so helps to reduce the size, weight, cost, and warranty-related issues of the engine assembly. In addition, disclosed VDV system designs allow oil flowing to the rocker arm to operate at different pressure levels than oil in the rocker shaft, which is maintained at engine oil pressure levels.

The solenoid-driven oil control valve (OCV) is fluidly in-line with the rocker shaft's internal oil bore and controls oil pressure to the VDV-switching rocker arms. An interior fluid passage within the rocker shaft insert sleeve routes oil from the rocker shaft to the OCV, whereas a distinct exterior fluid passage on the insert sleeve routes oil from the OCV to the VDV-switching rocker arms. The OCV may include a pressure regulator valve assembly to allow low-pressure oil to flow to the rocker arms during normal engine operation, e.g., to lubricate the pushrod-to-rocker arm contact points and rocker shaft-to-rocker arm shaft bore. When energized by the engine's electronic control unit (ECU), such as a dedicated Engine Control Module (ECM), the OCV deactivates a select subset of the engine cylinders by distributing high-pressure oil flow to the VDV-switching rocker arms to disable valve lift. The ECU/ECM signal activates the OCV solenoid to allow a ball valve of an internal one-way valve assembly to unseat from a control seat; at the same time, the OCV solenoid moves the ball valve to seat on a regulator seat to thereby seal off oil flow to the pressure regulator valve assembly. When the OCV is deactivated, the one-way OCV valve assembly is partially unseated to maintain a minimum pressure in the feed orifice to allow the control galleries to be primed and minimize oil aeration.

When the OCV is activated, pressurized oil is fed to a lost-motion spring lock unit that is mounted to or integrated with each of the VDV-switching rocker arms. The high-pressure oil presses against a spring-biased lock pin and thereby compresses a lock pin return spring to push the lock pin to an unlocked position. This allows a pushrod piston, which is operatively attached to a proximal (top) end of a pushrod, to translate against a lost-motion return spring inside the spring lock unit. When unlocked, the spring lock unit drivingly disengages the pushrod from the rocker arm such that each time the cam lobe rotates to lift the pushrod, the pushrod's linear force is dissipated against the lost-motion return spring. In effect, the pushrod, pushrod piston, and spring-biased lock pin translate while the rocker arm assembly remains stationary on the rocker shaft. When the cam lobe rotates out of its lift position, the lost-motion return spring biases the pushrod piston and, thus, the pushrod and spring-biased lock pin back towards the camshaft to ensure the pushrod maintains contact with the camshaft throughout the captured lift event.

It may be desirable that the rocker shaft insert sleeve be made from carbon steel, typically of a grade with a coefficient of thermal expansion that is as near as possible to that of the rocker shaft. Alternative embodiments may use other metallic, polymeric, and composite materials to fabricate the insert sleeve; however, the differences in coefficients of thermal expansion and strength should be optimized to prevent deformation that may induce seizing or mechanical failure of the system. It may be desirable that the insert sleeve be press-fit, slip-fit or transition-fit into the rocker shaft such that the sleeve's outer surface sits flush against the rocker shaft's inner surface. Alternative system architectures may include the use of seals to minimize or eliminate system leakage and corresponding pressure losses. The insert sleeve and rocker arm combination may be optimized in such a way to minimize the total volume of the control gallery, to achieve maximum acceptable aeration, and to yield an acceptable system response time. The VDV-switching rocker arms may be directly physically mounted onto the rocker shaft or indirectly mounted with the use of journal bearing, bushing, rolling bearing, etc., while ensuring adequate lubrication between the rocker shaft and rocker arm to prevent part-to-part welding.

Figure 2:
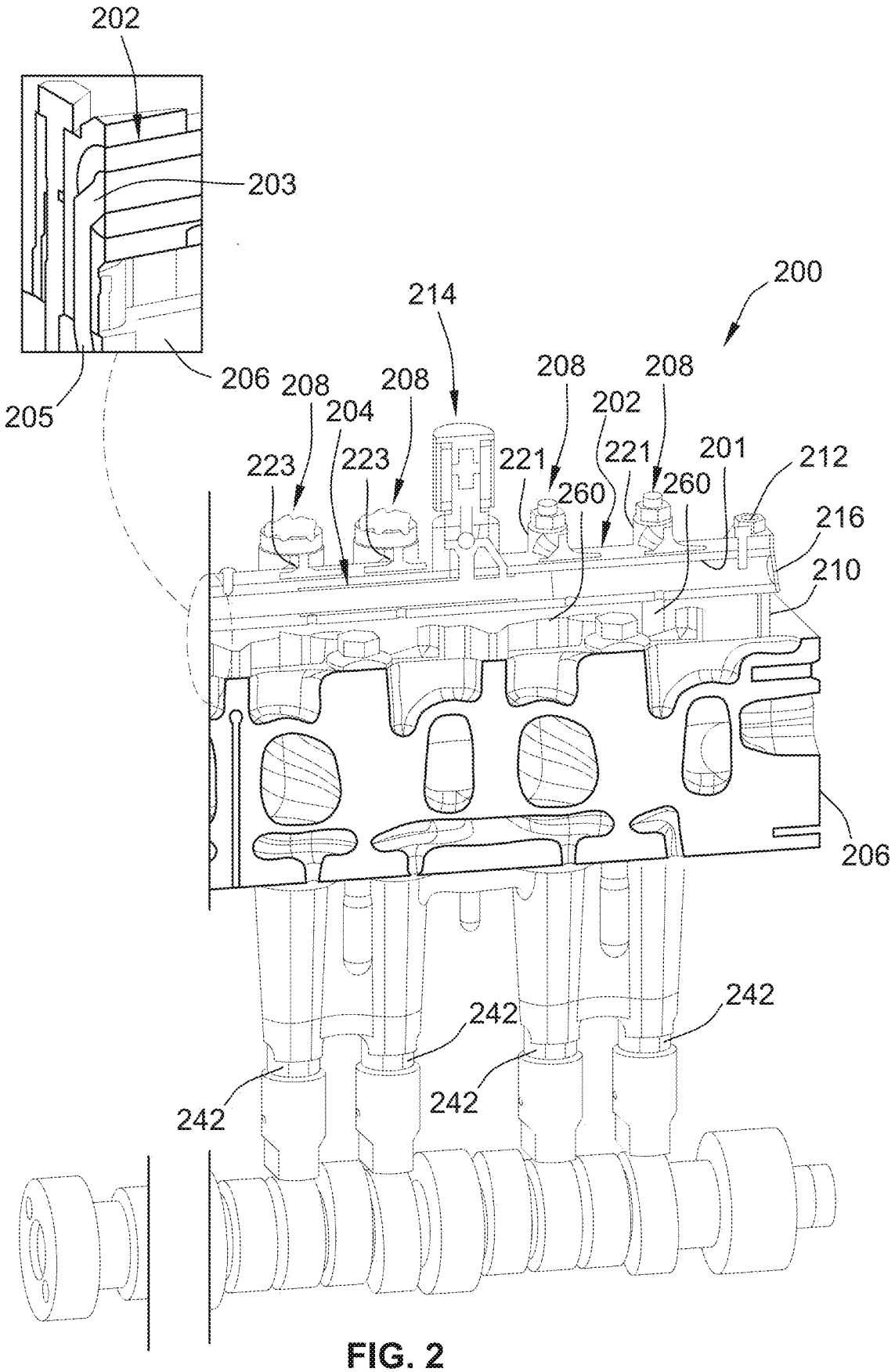
FIG. 2 is a partially cutaway, perspective-view illustration of a portion of a representative variable displacement valvetrain system with an oil-ported rocker shaft and a rocker shaft insert sleeve in accordance with aspects of the present disclosure.

FIG. 2 illustrates a representative variable displacement valvetrain system 200 with an oil-ported rocker shaft 202 and a rocker shaft insert sleeve 204 for deactivation of select valves and cylinders of an engine assembly, such as the intake valve(s) 120 and engine cylinder(s) 104 of FIG. 1. The rocker shaft 202 operatively attaches to an engine assembly and supports thereon one or more valve activating devices. In accord with the illustrated example, the rocker shaft 202 is rigidly mounted onto a top face of an engine cylinder head 206 (e.g., cylinder heads 126, 128 of FIG. 1) and pivotably supports a series of valvetrain rocker arms 208 (e.g., rocker arms 138, 140). Opposing longitudinal ends of the rocker shaft 202 may be slip-fit into respective pedestal mounts 210 of the cylinder head 206 and rigidly secured thereto via hex-head bolts 212. For simplicity of design and manufacture, the rocker shaft 202 may be an elongated and hollow right-circular cylinder that is formed as a single-piece structure from a rigid and resilient material (e.g., machined stainless steel pipe). It is envisioned that the rocker shaft 202 may be mounted at alternative locations on the cylinder head or engine block and may support thereon any number of rocker arms 208 depending, for example, on the layout and size of the engine assembly.

To lubricate and control the VDV system's valve activating devices, the rocker shaft 202 is fabricated with a pressurized internal bore ("internal shaft bore") 201 that receives hydraulic fluid from a fluid sump volume and routes the hydraulic fluid to the rocker arms 208. As best seen in the inset view of FIG. 2, for example, the rocker shaft 202 includes a rocker shaft inlet port 203 that projects through a sidewall of the shaft 202 and fluidly couples to a fluid feed passage 205 routed through the cylinder head 206. This fluid feed passage 205 may receive pressurized engine oil from an engine oil pan via an engine oil pump (not visible in the views provided), and feed the oil to the rocker shaft 202 via the inlet port 203. A rocker shaft outlet port 207 (FIG. 3) projects through a sidewall of the rocker shaft 202 and fluidly couples to the shaft's inlet port 203 via the internal shaft bore 201 and insert sleeve 204. The rocker shaft's outlet port 207 is directly fluidly coupled to an OCV inlet port 209 of an OCV unit 214 and a feed port 211 of the insert sleeve 204 (i.e., sans piping, valving, etc., therebetween). Optional end seals 216 may be inserted into open longitudinal ends of the rocker shaft 202 to fluidly seal the shaft 202 and sleeve 204.

Figure 3:
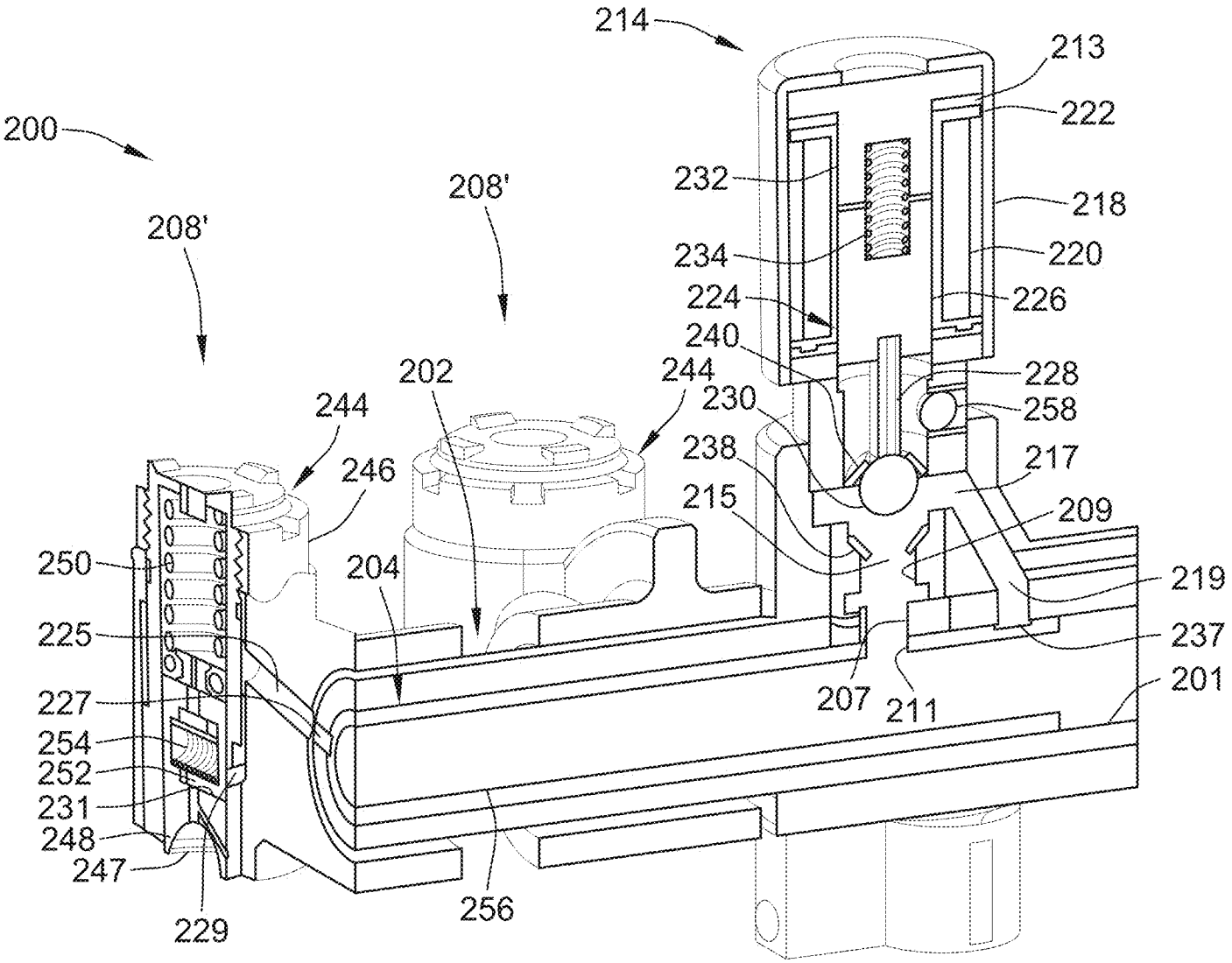
FIG. 3 is an enlarged and partially cutaway, perspective-view illustration of the rocker shaft, VDV rocker arms, rocker spring lock units, insert sleeve, and oil control valve of the representative variable displacement valvetrain system of FIG. 2.

Variable displacement valvetrain system 200 of FIGS. 2 and 3 employs an active flow-control valve to regulate the stream of hydraulic fluid to the VDV system's valve activating devices. According to the illustrated example, a controller-automated OCV unit 214 is operatively attached to the rocker shaft 202 and fluidly coupled to the rocker shaft's outlet port 207 to receive a portion of the hydraulic fluid flowing through the internal bore 201. The OCV unit 214 is shown mounted directly onto and circumscribing an outer-diameter (OD) surface of the rocker shaft 202, inserted between two of the rocker arms 208. While portrayed as a solenoid-driven valve, it is envisioned that the OCV unit 214 may take on alternative valve constructions, including pneumatically actuated and motor driven valving device. Moreover, a single OCV unit 214 may regulate oil feed to multiple rocker arms 208 (as shown) or may be dedicated to feeding oil to a single rocker arm 208.

With reference to FIG. 3, the OCV unit 214 includes a protective valve housing (or "can") 218 with an interior cavity 213 that extends through the valve housing 218 from a first (top) end to a second (bottom) end thereof. Sealed inside of the valve housing 218 are an annular polymeric bobbin 222 and an electromagnetic coil 220 that is coaxial with and wound around the bobbin 222. A solenoid armature assembly, designated generally at 224 in FIG. 3, is a tripartite construction that moves as a single unit within the valve housing 218, e.g., along a generally rectilinear path. This armature assembly 224 is generally composed of a cylindrical armature 226 that is circumscribed by the coil 220, an elongated valve arm 228 that is fixed to and projects axially from a distal (bottom) end of the armature 226, and a check ball 230 that abuts a distal (bottom) end of the valve arm 228. The armature 226 is located immediately adjacent a valve pole piece 232 with a helical return spring 234 that biases the armature 226 away from the pole piece 232. The armature 226 is fabricated from a metal or metal alloy material, such as steel or iron, to selectively slide within the interior cavity 213 (e.g., vertically upwards in FIG. 3) in response to active energization of the coil 220.

Located at a distal (bottom) end of the valve housing 218 is an OCV inlet chamber 215 that is fluidly coupled to the OCV inlet port 209 and, via the inlet port 209, to the rocker shaft's outlet port 207. Fluidly downstream from the inlet chamber 215 is an OCV control duct 217 that fluidly couples to the inlet chamber 215 and an OCV outlet port 219. A check valve, such as check ball 230, is interposed between and restricts the flow of hydraulic fluid across the inlet chamber 215 and control duct 217. The check ball 230 is movable to seat against a first (inlet) valve seat 238 and, separately, a second (relief) valve seat 240. A vehicle ECU/ECM is programmed to selectively switch the OCV unit 214 back-and-forth between an OFF state to an ON state. When the OCV unit 214 is in the OFF state, the check ball 230 at least partially seats against the first valve seat 238 to thereby restrict flow of hydraulic fluid from the OCV inlet port 209 to the OCV outlet port 219. It may be desirable that the solenoid armature assembly 224 hold the check ball 230 partially unseated from the first valve seat 238 to maintain a predefined priming pressure in the hydraulic fluid when the OCV unit 214 is OFF. When the OCV unit 214 is transitioned by the ECU/ECM to the ON state, the solenoid armature assembly 224 fully unseats the check ball 230 from the first valve seat 238 to enable a generally unrestricted flow of hydraulic fluid from the OCV's inlet port 209 to the OCV's outlet port 219. The armature assembly 224 may shift upwards such that the check ball 230 is allowed to seat against the second valve seat 240 to restrict fluid flow to a spring-biased, bally-type pressure relief valve 258 when the OCV unit 214 is ON.

Each rocker arm 208 is pivotably mounted onto the rocker shaft 202, with a first (rocker) end 221 of the arm 208 operatively mating with a respective pushrod 242 and a second (rocker) end 223 of the arm 208 operatively mating with a respective valve 260. A select subset of the rocker arms 208', namely those that are not eligible for select deactivation, may mate with their respective pushrods 242 and valves 240 in the manner described above with respect to the rocker arms 138, 140 of FIG. 1. Conversely, a different select subset of the rocker arms 208 (designated 208' in FIG. 3), namely those that are eligible for select "variable displacement" deactivation (also referred to herein as "VDV-switching rocker arms"), each has a respective spring lock unit (or "deactivation (DEAC) unit") 244 (FIG. 3) attached to the first end 221 of the arm 208 to drivingly couple and decouple that rocker arm 208 to/from its pushrod 242. Each spring lock unit 244 has a protective lock housing (or "DEAC body") 246 with a pushrod seat 247 that seats therein a complementary pushrod ball on a proximal (top) end of its respective pushrod 242. The rocker arm 208 and lock housing 246 may be integrally formed with each other as a single-piece structure or may be individually fabricated as separate parts that are then rigidly coupled together (as shown).

To drivingly disengage the rocker arms 208 from the pushrods 242, the OCV unit 214 fluidly couples to and feeds a metered portion of the hydraulic fluid to each of the spring lock units 244. As best seen in FIG. 3, for example, each of the VDV-switching rocker arms 208' includes an internal inlet channel 225 that fluidly couples to a rocker shaft feed orifice 227, which extends through a circumferential sidewall of the rocker shaft 202. The rocker arm inlet channel 225 fluidly couples the feed orifice 227 to a piston chamber 229 inside the spring lock unit's housing 246. A pushrod piston (or "pin housing") 248, when unlocked, is reciprocally slidable within the lock housing 246 to translate along a linear path (e.g., from top to bottom in FIG. 3) in response to compressive forces applied by the pushrod 242. The pushrod seat 247 is recessed into a terminal (bottom) end of the pushrod piston 248 to seat therein one end of the pushrod 242. A lost-motion return spring 250, which may be in the nature of a helical compression spring, is disposed inside the lock housing 246 and pressing against a proximal (top) face of the pushrod piston 248 to bias the piston 248 towards a distal (bottom) end of the lock housing 246.

To selectively lock the piston 248 to the housing 246, a spring-biased lock pin 252 is disposed inside of the lock housing 246 and slidably inserted into a complementary lock pin slot 231 recessed into a lateral side of the pushrod piston 248. A lock pin return spring 254, which may be in the nature of a helical compression spring, is seated inside the pin slot 231 and compressed between the lock pin 252 and the pushrod piston 248. In the absence of hydraulic fluid of sufficient pressure to compress the spring 254, the lock pin return spring 254 biases the lock pin 252 laterally out of an open end of the lock pin slot 231 and into abutting contact with a complementary recess in a sidewall of the lock housing 246. Doing so locks the pushrod piston 248 to the lock housing 246 such that driving forces applied to the pushrod piston 248 by the pushrod 242 are transmitted from the piston 248 and pin 252, through the lock housing 246, to the rocker arm 208'.

In the presence of hydraulic fluid of sufficient pressure to overcome the spring force of the return spring 254, the lock pin 252 is pushed against and compresses the return spring 254. At the same time, the lock pin 252 slides out of abutting contact with the complementary recess in the lock housing 246. Doing so disengages the spring-biased lock pin 252 and thereby unlocks the pushrod piston 248 such that the piston 248 is free to translate against the lost-motion return spring 250. When unlocked, driving forces and motion applied to the pushrod piston 248 by the pushrod 242 are not transmitted from the piston 248 to the rocker arm 208' but are rather dissipated by the lost-motion return spring 250. Additional information about the spring lock unit, including its contents and operation, may be found, for example, in commonly owned U.S. patent application Ser. No. 18/662,889, to Opipari et al., which was filed on May 13, 2024, is entitled "Engine Valvetrain Deactivation System with Switchable Rocker Arm Cam Lift", and is incorporated herein by reference in its entirety and for all purposes.

Unlike other available variable displacement valvetrain systems, the VDV system 200 of FIGS. 2 and 3 employs a fluid-ported rocker shaft 202 with an internal rocker shaft insert sleeve 204 to route hydraulic fluid from the OCV unit 214 to the spring lock unit 244 to provision select engine cylinder deactivation. According to the illustrated example, one or more insert sleeves 204 are rigidly mounted inside the internal shaft bore 201 to receive hydraulic fluid from the cylinder head feed passage 205 through the rocker shaft 202. For simplicity of design and manufacture, each insert sleeve 204 may be cast and precision machined as an elongated and hollow single-piece structure that is formed, in whole or in part, from a metallic material. Alternatively, the sleeve may be molded from a rigid plastic material. While not per se limited, the insert sleeve 204 of FIG. 3 has an open-ended tubular sleeve body 256 that is fabricated from carbon steel and has a right-circular cylinder shape. It should be appreciated that the number, shape, size, and/or location of the insert sleeve(s) 204 may be varied from that which are shown in the drawings.

Figure 4A:
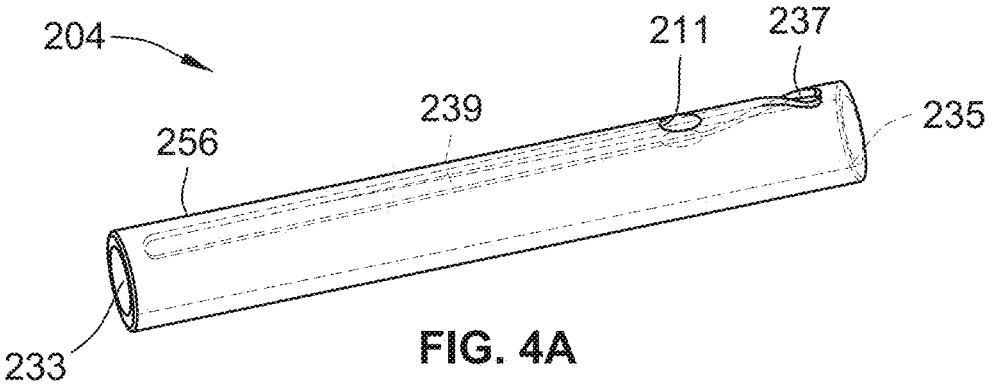
FIGS. 4A and 4B are perspective view illustrations of the rocker shaft insert sleeve of the representative variable displacement valvetrain system of FIG. 2.
Figure 4B:
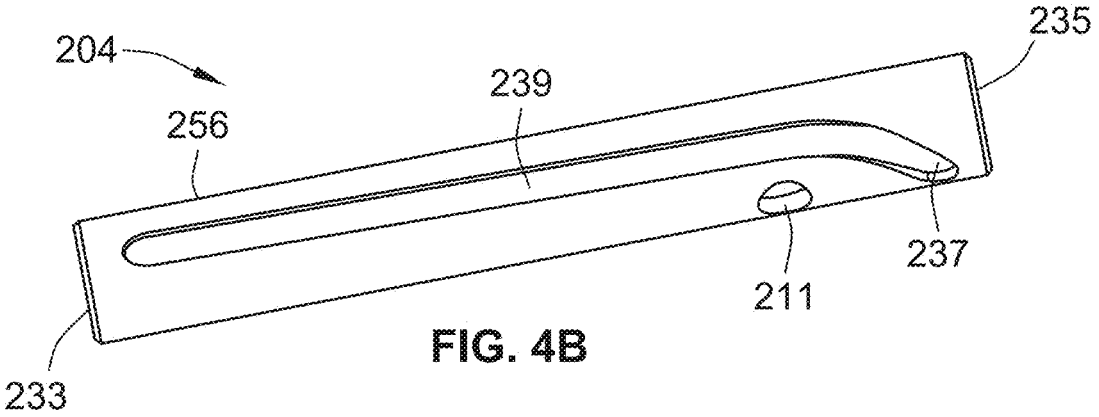

As shown in FIGS. 4A and 4B, opposing first and second longitudinal ends 233 and 235, respectively, of the sleeve body 256 may be open and unobstructed such that hydraulic fluid may freely pass through the insert sleeve 204. As noted above, a through-hole-type feed port 211 extends through a sidewall of the sleeve body 256 and fluidly connects to the rocker shaft outlet port 207 and OCV inlet port 209 to transmit hydraulic fluid from the insert sleeve 204 to the OCV unit 214. Fluidly downstream from the outlet port 207, inlet port 209, and feed port 211 is a feed pocket 237 that fluidly couples to and transmits hydraulic fluid received from the OCV outlet port 219 to the VDV-switching rocker arms 208'. This feed pocket 237 is portrayed as a narrow channel that is recessed into the OD sleeve surface of the sleeve body 256, as best seen in FIGS. 4A and 4B. The insert sleeve 204 of FIGS. 4A and 4B also includes an elongated and substantially linear worm track 239 that is recessed into the OD sleeve surface of the sleeve body 256 and fluidly couples to the feed pocket 237 (e.g., forming a single, arcuate channel that transmits fluid across the outer periphery of the sleeve 204). This worm track 239 is portrayed as a narrow channel that is recessed into the OD sleeve surface of the sleeve body 256, extending longitudinally along a length of the insert sleeve 204. The worm track 239 fluidly couples the sleeve's feed pocket 237 and the OCV's outlet port 219 to the rocker shaft's feed orifice 227 and the rocker arm's inlet channel 225. It may be desirable that the OD sleeve surface of the insert sleeve's body 256 sit substantially flush against and thereby seals to an inner-diameter (ID) surface of the rocker shaft 202. With this arrangement, oil inlet flow routes through the interiors of the rocker shaft 202 and insert sleeve 204 to the OCV unit 214, and from the OCV unit 214 across the ID surface of the rocker shaft 202 and the exterior of the sleeve 204.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A valvetrain control system for an engine assembly having a cylinder, a valve for opening and closing a port to the cylinder, a camshaft rotatably attached proximate the valve, and a pushrod seated on a cam of the camshaft, the valvetrain control system comprising:

a rocker shaft configured to attach to the engine assembly and including an internal shaft bore configured to receive hydraulic fluid;

an oil control valve (OCV) unit attached to the rocker shaft and fluidly coupled to the internal shaft bore to receive therefrom the hydraulic fluid;

a rocker arm pivotably mounted onto the rocker shaft and having a first rocker end configured to mate with the pushrod and a second rocker end configured to mate with the valve;

a spring lock unit attached to the first rocker end and configured to attach the pushrod, the spring lock unit fluidly coupled to the OCV unit to receive therefrom the hydraulic fluid to thereby drivingly disengage the rocker arm from the pushrod; and an insert sleeve mounted in the internal shaft bore to receive the hydraulic fluid from the rocker shaft, the insert sleeve including a feed port transmitting the hydraulic fluid from the insert sleeve to an OCV inlet port of the OCV unit, and a feed pocket transmitting the hydraulic fluid from an OCV outlet port of the OCV unit to the spring lock unit.

2. The valvetrain control system of claim 1, wherein the insert sleeve further includes an elongated and hollow sleeve body, wherein the feed port extends through a sleeve wall of the sleeve body, and wherein the feed pocket is recessed into an outer sleeve surface of the sleeve body.

3. The valvetrain control system of claim 2, wherein the insert sleeve further includes a worm track recessed into the outer sleeve surface of the sleeve body, fluidly coupled to the feed pocket, and extending longitudinally along a length of the insert sleeve.

4. The valvetrain control system of claim 3, wherein the rocker arm includes an inlet channel fluidly coupling the spring lock unit to a feed orifice extending through a circumferential shaft wall of the rocker shaft, the worm track fluidly coupling the inlet channel and the feed orifice to the feed pocket and the OCV outlet port of the OCV unit.

5. The valvetrain control system of claim 2, wherein the outer sleeve surface of the insert sleeve sits flush against and seals to an inner shaft surface of the rocker shaft.

6. The valvetrain control system of claim 2, wherein the insert sleeve is a single-piece cylindrical structure formed with a metallic material.

7. The valvetrain control system of claim 1, wherein the OCV unit further includes an inlet chamber fluidly coupled to the OCV inlet port, a control duct fluidly coupled to the OCV outlet port, and a check valve interposed between the inlet chamber and control duct, the OCV unit being selectively switchable between an OFF state, in which the check valve restricts flow of hydraulic fluid from the OCV inlet port to the OCV outlet port, and an ON state, in which the check valve enables the flow of hydraulic fluid from the OCV inlet port to the OCV outlet port.

8. The valvetrain control system of claim 7, wherein the check valve includes a check ball and a valve seat, the check ball being at least partially unseated from the valve seat to maintain a predefined priming pressure in the hydraulic fluid when the OCV unit is in the OFF state.

9. The valvetrain control system of claim 1, wherein the spring lock unit includes a lock housing, a pushrod piston translatable within the lock housing and including a pushrod seat configured to seat therein one end of the pushrod, and a spring-biased lock pin locking the pushrod piston to the lock housing, the hydraulic fluid from the insert sleeve and the OCV unit disengaging the spring-biased lock pin to thereby unlock the pushrod piston.

10. The valvetrain control system of claim 9, wherein the lock housing is integrally formed with the first rocker end of the rocker arm, and wherein disengaging the spring-biased lock pin enables the pushrod piston and the pushrod to translate against a return spring in the lock housing.

11. The valvetrain control system of claim 1, wherein the OCV unit mounts onto and circumscribes an outer-diameter (OD) surface of the rocker shaft.

12. The valvetrain control system of claim 1, wherein the engine assembly includes a cylinder head mounted onto an engine block, and wherein the rocker shaft further includes a shaft inlet port configured to fluidly couple to and receive the hydraulic fluid from a feed passage in the cylinder head.

13. The valvetrain control system of claim 12, wherein the rocker shaft further includes a shaft outlet port fluidly coupled to the shaft inlet port via the internal shaft bore, and wherein the shaft outlet port is fluidly coupled to the OCV inlet port via the feed port of the insert sleeve.

14. A motor vehicle, comprising:

a vehicle body;

a plurality of road wheels attached to the vehicle body; and an internal combustion engine (ICE) assembly attached to the vehicle body and operable to drive one or more of the road wheels to thereby propel the motor vehicle, the ICE assembly including:

an engine block defining a plurality of cylinder bores, a cylinder head mounted onto the engine block and covering the cylinder bores;

a plurality of pistons each reciprocally movable within a respective one of the cylinder bores;

a plurality of intake valves movably attached to the cylinder head and each operable to open and close a port to a respective one of the cylinder bores;

a camshaft rotatably attached to the engine block and bearing a plurality of cams;

a plurality of pushrods each having a first rod end slidably seated on a respective one of the cams of the camshaft;

a rocker shaft mounted onto the cylinder head and defining an internal shaft bore configured to receive hydraulic fluid from a feed passage in the cylinder head;

an oil control valve (OCV) unit attached to the rocker shaft and fluidly coupled to the internal shaft bore to receive therefrom the hydraulic fluid;

a plurality of rocker arms pivotably mounted onto the rocker shaft and each having a first rocker end mating with a second rod end of a respective one of the pushrods, and a second rocker end mating with a valve stem of a respective one of the intake valves, a subset of the rocker arms each having a respective spring lock unit attached to the first rocker end of the rocker arm and attached to the second rod end of the respective one of the pushrods, each of the spring lock units being fluidly coupled to the OCV unit to receive therefrom the hydraulic fluid to thereby drivingly disengage the rocker arm from the pushrod; and an insert sleeve mounted inside of the internal shaft bore of the rocker shaft to receive therefrom the hydraulic fluid, the insert sleeve having a feed port transmitting the hydraulic fluid from the insert sleeve to an OCV inlet port of the OCV unit, and a feed pocket transmitting the hydraulic fluid from an OCV outlet port of the OCV unit to the spring lock units of the subset of the rocker arms.

15. A method of assembling a valvetrain control system for an engine assembly having a cylinder, a valve for opening and closing a port to the cylinder, a camshaft rotatably attached proximate the valve, and a pushrod seated on a cam of the camshaft, the method comprising:

attaching a rocker shaft to the engine assembly, the rocker shaft including an internal shaft bore configured to receive hydraulic fluid;

attaching an oil control valve (OCV) unit to the rocker shaft;

fluidly coupling the OCV unit to the internal shaft bore of the rocker shaft to receive therefrom the hydraulic fluid;

pivotably mounting a rocker arm onto the rocker shaft;

mating a first rocker end of the rocker arm with the pushrod;

mating a second rocker end of the rocker arm with the valve;

attaching a spring lock unit attached to the first rocker end of the rocker arm to the pushrod;

fluidly coupling the spring lock unit to the OCV unit to receive therefrom the hydraulic fluid to thereby drivingly disengage the rocker arm from the pushrod; and mounting an insert sleeve in the internal shaft bore to receive the hydraulic fluid from the rocker shaft, the insert sleeve including a feed port transmitting the hydraulic fluid from the internal shaft bore and the insert sleeve to an OCV inlet port of the OCV unit, and a feed pocket transmitting the hydraulic fluid from an OCV outlet port of the OCV unit to the spring lock unit.

16. The method of claim 15, wherein the insert sleeve further includes a cylindrical and hollow sleeve body, wherein the feed port extends through a sleeve wall of the sleeve body, and wherein the feed pocket is recessed into an outer-diameter (OD) sleeve surface of the sleeve body.

17. The method of claim 16, wherein the insert sleeve further includes a worm track fluidly coupled to the feed pocket, recessed into the OD sleeve surface of the sleeve body, and extending longitudinally along a length of the insert sleeve, the worm track fluidly coupling the spring lock unit to the OCV unit.

18. The method of claim 15, wherein the OCV unit further includes an inlet chamber fluidly coupled to the OCV inlet port, a control duct fluidly coupled to the OCV outlet port, and a check valve interposed between the inlet chamber and the control duct, the OCV unit being selectively switchable between an OFF state, in which the check valve restricts flow of hydraulic fluid from the OCV inlet port to the OCV outlet port, and an ON state, in which the check valve enables the flow of hydraulic fluid from the OCV inlet port to the OCV outlet port.

19. The method of claim 18, wherein the check valve includes a check ball and a valve seat, the check ball being at least partially unseated from the valve seat to maintain a predefined priming pressure in the hydraulic fluid when the OCV unit is in the OFF state.

20. The method of claim 15, wherein the spring lock unit includes a lock housing, a pushrod piston translatable within the lock housing and including a pushrod seat configured to seat therein one end of the pushrod, and a spring-biased lock pin locking the pushrod piston to the lock housing, the hydraulic fluid from the insert sleeve and the OCV unit disengaging the spring-biased lock pin to thereby unlock the pushrod piston.

* * * * *